US010718599B1

(12) United States Patent
Kirsch

(10) Patent No.: US 10,718,599 B1
(45) Date of Patent: Jul. 21, 2020

(54) AUTOMATIC PRIMER COLLATOR

(71) Applicant: Double-Alpha Academy B.V., Waalwijk (NL)

(72) Inventor: Saul J. Kirsch, Waalwijk (NL)

( * ) Notice: Subject to any disclaimer, the term of this patent is extended or adjusted under 35 U.S.C. 154(b) by 0 days.

(21) Appl. No.: 16/556,829

(22) Filed: Aug. 30, 2019

(51) Int. Cl.
*F42B 33/00* (2006.01)
*F42B 33/04* (2006.01)
*F42B 33/02* (2006.01)

(52) U.S. Cl.
CPC ..... *F42B 33/002* (2013.01); *F42B 33/02* (2013.01); *F42B 33/04* (2013.01)

(58) Field of Classification Search
CPC ..... F42B 33/002; F42B 33/02; F42B 33/04; F42B 33/00; F42B 33/0257
USPC ..... 86/24, 29, 31, 32, 36, 45
See application file for complete search history.

(56) References Cited

U.S. PATENT DOCUMENTS 2,387,672 A 10/1945 Mayherry
2,413,047 A 10/1946 Huddleson et al.
2,824,484 A 2/1958 Thompson
3,602,084 A 8/1971 Corcoran
3,635,325 A * 1/1972 Sterling ..... B65G 47/1428 198/397.05
4,163,410 A 8/1979 Dillon
43,124,368 1/1982 Valsvog
4,343,222 A 8/1982 Dillon
4,475,435 A 10/1984 Mantel
4,573,392 A 3/1986 Mantel
5,179,243 A 1/1993 Schroeder
5,198,606 A * 3/1993 Storstad ..... F42B 33/04 86/32
5,693,905 A * 12/1997 Blodgett ..... F42B 33/04 86/23
7,497,155 B2 3/2009 Koskela
7,549,364 B2 6/2009 Koskela
7,552,668 B1 * 6/2009 Gonzalez ..... F42B 33/00 86/45
7,694,618 B1 * 4/2010 Lee ..... F42B 33/001 86/32

(Continued)

OTHER PUBLICATIONS

Vibra Prime, Frankford Arsenal, 2020, https://www.frankfordarsenal.com/reloading-tools/priming-and-depriming-tools/primer-tools/vibra-prime/855712.html.

(Continued)

*Primary Examiner* — John Cooper
(74) *Attorney, Agent, or Firm* — AnnMarie W. Whitley; Whitley Legal Group, P.C.

(57) ABSTRACT

A primer collator useful with primer tubes includes a funnel, sorting assembly, output ramp assembly, and counting assembly. The funnel rotates and directs primers to a sorting assembly, which defines slots formed by a priming disc and timing disc that cooperate and rotate within a disc housing. In each slot, a lower ramp and ridge section and upper tooth section are configured to interact with primers to stop improperly oriented primers. Properly oriented primers travel through the slots to an outer groove formed by the disc housing to be transported to the output ramp. The counting assembly counts primers as they travel on the output ramp and powers off the collator after a preset number of primers are counted. Additional features include a magnetic tube attachment assembly and a timing assembly that meters the dispensing of primers into the tube while also stabilizing them to prevent errors.

20 Claims, 11 Drawing Sheets

(56) References Cited

U.S. PATENT DOCUMENTS

| | | | |
|---|---|---|---|
| 8,661,959 | B2 | 3/2014 | Koskela |
| 2002/0121184 | A1 | 9/2002 | Fowler |

OTHER PUBLICATIONS

Primer Filler, Nov. 1, 2001, https://www.youtube.com/watch?v=OV1GwJwBD3Q&feature=youtu.be.
Camdex automatic primer machine, May 24, 2014, https://www.youtube.com/watch?v=_NT5w64h_gY&feature=youtu.be.
Dillon primer flip tray, Feb. 1, 2018, https://www.youtube.com/watch?v=odLtNtM1Cl&feature=youtu.be.
2100 Series Pistol Loading Machine, Camdex Automatic Ammunition Systems, http://www.camdexloader.com/2100Pistol.aspx.

* cited by examiner

AUTOMATIC PRIMER COLLATOR

FIELD OF THE INVENTION

The present invention relates to ammunition reloading and more specifically to a novel and useful primer collator useful for filling primer tubes.

BACKGROUND OF THE INVENTION

Many professional and amateur shooting competitors and enthusiasts prefer to reload bullets to save money, to improve accuracy, to accommodate specialty ammunition needs, or simply because they enjoy it. Reloading works for most kinds of ammunition, which consists of a cartridge or case, primer, powder, and a bullet. To reload bullets, several pieces of equipment can be desirable including a reloading press. Reloading bullets requires that the case be first pressed to factory specifications, the old primer removed, and then loaded with a new primer and powder. After the case is loaded with powder, a new bullet can be seated on top of the powder.

The types of presses suitable for reloading include single stage reloading presses that hold one die at a time, turret presses that hold multiple dies simultaneously, and progressive reloading presses that include multiple stations in its shell plate such that each cycle of the press handle progresses the case from one station to the next. For example, the first station is for sizing and decapping the case, the second station is often used for inserting a new primer, and the third station is usually used for filling a measured charge of powder using a powder dropper. The fourth station can be used for a powder check, which is used to confirm that the amount of powder in the case is roughly correct, and later stations are generally used to place, seat and crimp the bullet. Progressive reloading presses can be manual-index or auto-index and are commonly used by pistol shooters and semi-automatic rifle shooters or anyone with high volume reloading needs.

To insert a new primer with a progressive reloading press, typically a primer seating tool cooperates with new primers introduced with a standard primer tube. A primer tube can also be used with a dedicated priming tool as well. Standard primer tubes hold 100 primers in sequence. To load the primer tube, primers are either dropped into the top end of the primer tube with an automated primer filler or loaded into the bottom end of the primer tube if picked up manually. Primers should be loaded so that the flat side of the primer faces away from the top end of the primer tube. A removable stopper, pin, or cap sits at the opposite end to prevent the primers from exiting the tube prematurely. Once the tube is loaded with the desired number of primers, it is ready to be attached to the primer tool or to be used to transfer primers to a fixed primer tube that is part of the primer tool. To transfer the primers to a fixed primer tube, the tube is placed over the fixed primer tube and aligned with chamfers. Then, the stopper is removed to allow all of the primers to slide into the fixed primer tube. To dispense primers directly from the moveable primer tube, the tube is placed so that individual primers can be dispensed, and the stopper is removed.

Unfortunately, loading primers into a primer tube is a tedious and time-consuming task. Primers are very small (just 4.4 mm in diameter) and almost impossible to handle by hand, yet it is critical that the primers are loaded correctly. In order to facilitate proper loading, several primer filler solutions are commercially available. The simplest solution is to use a flip tray with a serrated surface. The user shakes and slides the tray around to orient all the primers so that they lay anvil-side up. Then, using a lid, the user flips the tray so the primers are oriented anvil-side-down. The anvil-side-down primers can then be manually picked up one-by-one using a pickup tube, which is then flipped over before loaded in a primer tool or machine and eventually into an empty shell case. Unfortunately, shaking the tray and then picking up individual primers remains tedious and slow. Another option is to use a semi-automatic vibrating primer filler after using a flip tray to properly orient the primers. The vibrating primer filler attaches to a flip tray and then, when activated, it vibrates the tray to coax the primers toward an opening that cooperates with the top end of the primer tube. The primers then fall into the tube. Unfortunately, one still must take significant time to shake and flip the tray to orient the primers.

Fully automated primer fillers are also available commercially. In general, such fillers use a vibrating bowl or tray to deliver primers to a ramp. Once the primers are on the ramp, they travel upwards to an output location that cooperates with the top end of a primer tube. If the primers are upside down as they travel along the ramp, they fall off and back into the bowl or tray as they travel over a notched section of the ramp. Unfortunately, these automated primer fillers are noisy, expensive, slow, and unreliable. Primers don't move well in the bowl, primers often get stuck at the output location, and occasionally upside-down primers make it past the notched section of the ramp and load into the tube incorrectly, which is a costly and time-consuming mistake. When primers are incorrectly oriented in the primer tube, they will be seated the wrong way in the ammunition. Once a primer is seated incorrectly, the entire bullet is lost, or one must spend additional time taking the loaded ammunition apart. In addition to the reliability issues, these commercially available automated systems run on a timer rather than with a counter, and they have an unpredictable output speed.

Because filling a primer tube correctly and efficiently is very useful when reloading ammunition, it would be desirable to provide an automated system that collates and loads a primer tube with greater accuracy. Additionally, it would be desirable to count primers as they fill the primer tube, to fill the tube with less noise and with greater speed, to reduce jams when filing the tube, and to accommodate many brands and versions of primer tubes. Such a primer filler would be a notable advance in the firearm and ammunition arts.

BRIEF SUMMARY OF THE INVENTION

In accordance with the present invention a novel and useful primer collator for use with a primer tube is provided. The primer collator relies on a sorting assembly positioned below a funnel that is attached to a housing on an angle. The housing also supports an output ramp assembly with a counting assembly, a timing assembly, and a tube attachment assembly. The funnel can hold more than 300 primers and rotates along with components of the sorting assembly to sort and move primers into one of twenty slots formed by a disc housing, primer disc, and timing disc. The primer disc and timing disc define irregular slots that include ramp and ridged sections underneath raised and tooth sections, respectively. While any primer that is laying flat rather than resting on its side can fall into a slot when the slots are oriented in their lowest position, only primers that are properly oriented can pass by the ramp and tooth section. As the primer disc and timing disc rotate, all primers in slots are carried around to higher positions. The properly oriented primers travel in a groove formed by the disc housing near its perimeter, while the improperly orient primers travel in slots just before the tooth and ramp section. As the primers rotate to the highest position, the improperly oriented primers slide back into the funnel, and the properly oriented primers fall through an output port.

After exiting the sorting assembly through the output port, primers are directed to an output ramp assembly that is also partly supported by the housing. The exit ramp tilts downward to encourage the primers to slide down the ramp easily, and a lid over the exit ramp prevents the primers from tumbling, turning, or flipping as they slide. Partway down the ramp, a counting assembly is positioned above and below the ramp to count the primers that pass by. The counting assembly includes a light source above the ramp and a light sensor below the ramp. Every time the sensor recognizes an absence of light, it counts a primer. Located alongside the ramp are components of a timing assembly. The timing assembly cooperates with the timing disc of the sorting assembly. The timing disc includes several steps along its perimeter that cause a timing lever to pivot between first and second positions. The timing lever attaches to a connection rod, which connects to a stabilizing arm. The stabilizing arm extends into the ramp to catch and hold primers. Every time the timing lever moves from a first position to a second position, the stabilizing arm retracts to allow a primer to drop to a primer tube located underneath the ramp and to grab another primer. When the timing lever moves back to its first position, the stabilizing arm moves and stabilizes the newly acquired primer over the attached primer tube. The primer tube optionally attaches to the ramp magnetically using a removable magnet and cooperating adaptor assembly.

To operate the primer collator, an operator attaches a primer tube near the bottom of the output ramp, pour primers into the funnel, and waits as the funnel and sorting assembly rotate to sort the primers. Primers that are oriented anvil-side-up are delivered to the output ramp, and primers that are oriented anvil-side-down are returned to the funnel. As the primers exit the sorting assembly and slide down the output ramp, they are counted by the counting assembly. At the same time, the timing assembly and stabilizing arm prepares the primers to fall into the primer tube correctly. After counting 100 primers, the counting assembly triggers the primer collator to stop sorting. The operator can then remove the primer tube and transfer its contents into his reloading press. It is estimated that the primer collator can fill a primer tube with 100 primers in about 45-60 seconds.

The features and advantages of the present invention will be readily apparent to those skilled in the art upon a reading of the description of the exemplary embodiments, which follows.

For a better understanding of the invention reference is made to the following detailed description of the preferred embodiments of the invention which should be taken in conjunction with the above described drawings.

DETAILED DESCRIPTION OF THE INVENTION

Figure 1A:
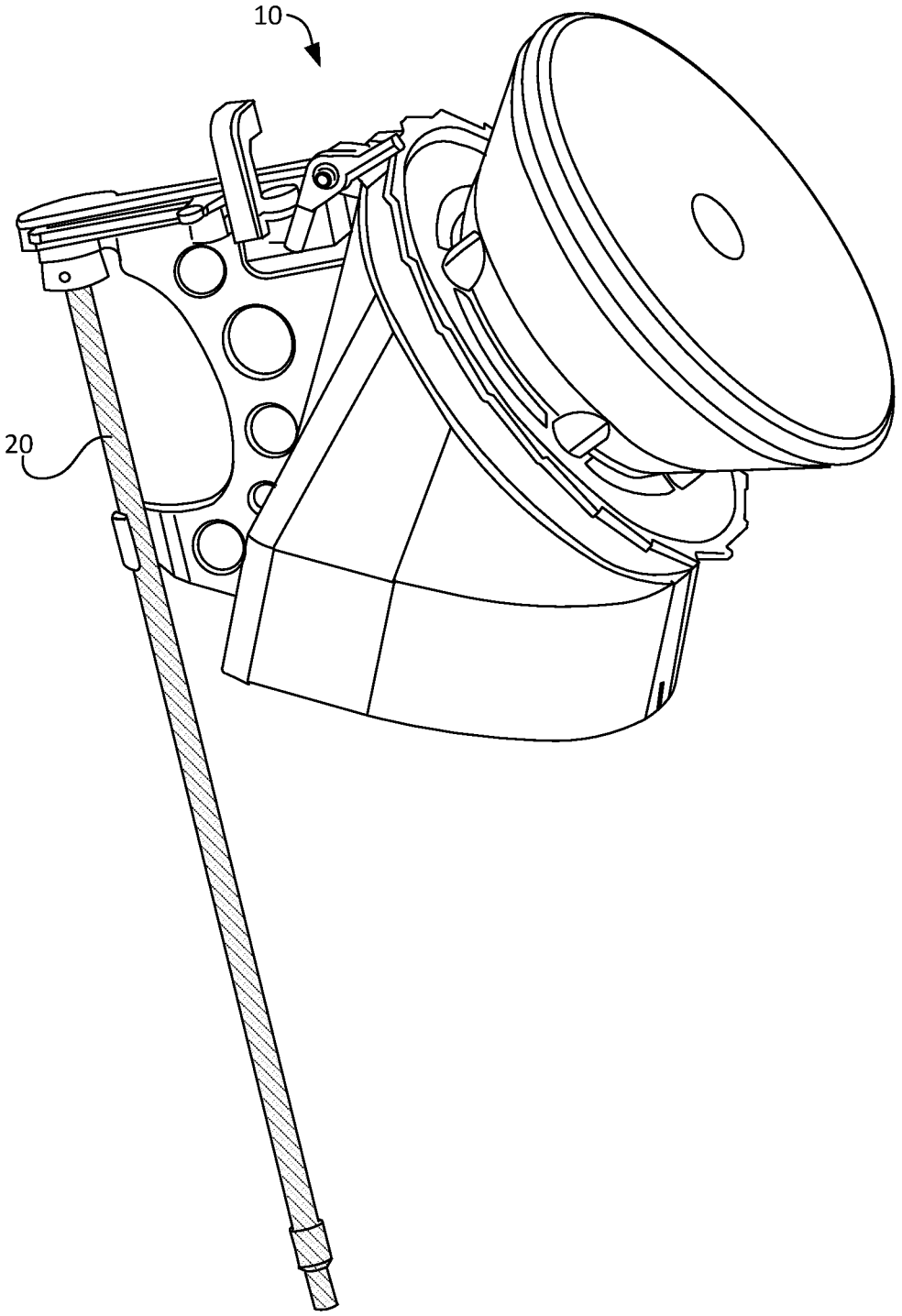
FIG. 1A is a perspective view of the primer collator of the present invention connected to a primer tube.
Figure 1B:
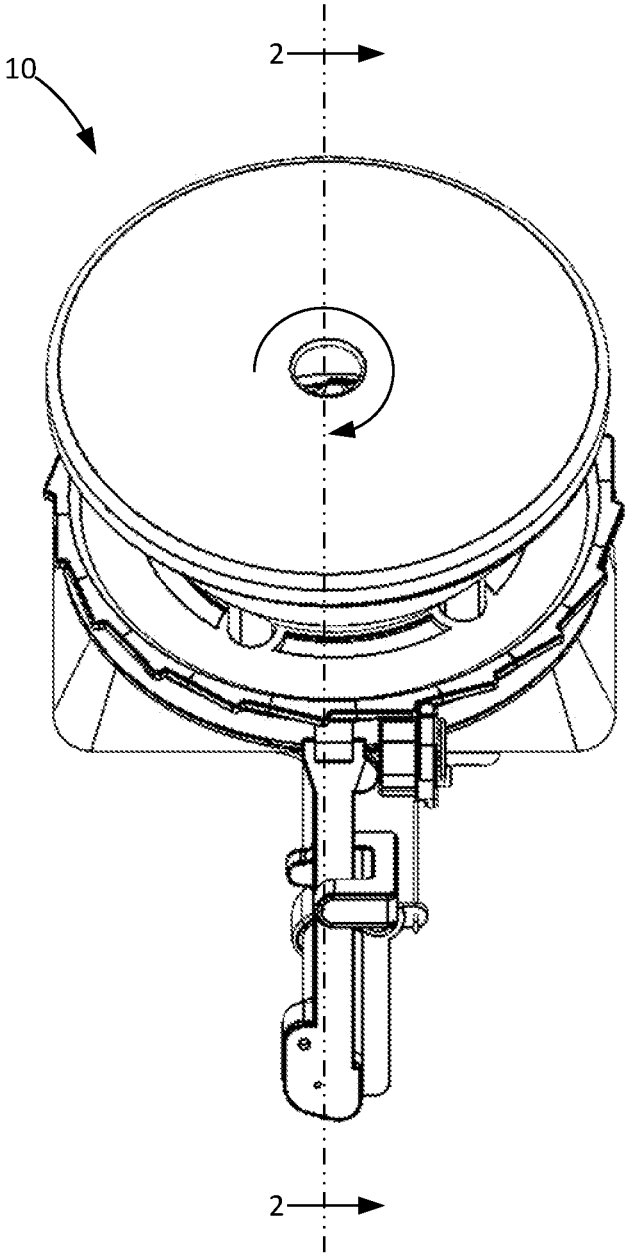
FIG. 1B is a top view of the primer collator of the present invention connected to a primer tube.
Figure 2:
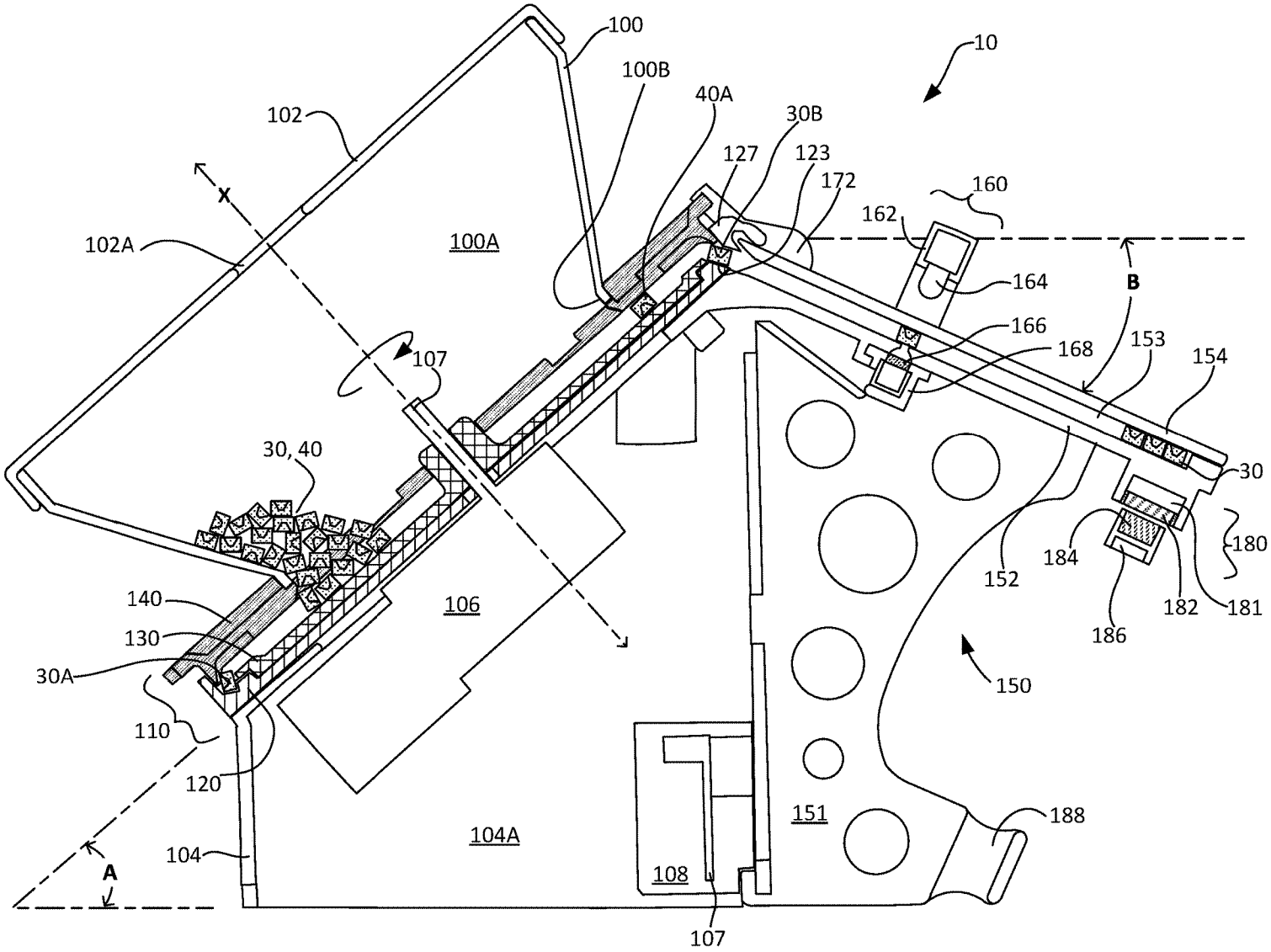
FIG. 2 is a cutaway view of the primer collator of the present invention as cut along the line marked 2-2 in FIG. 1B.
Figure 3:
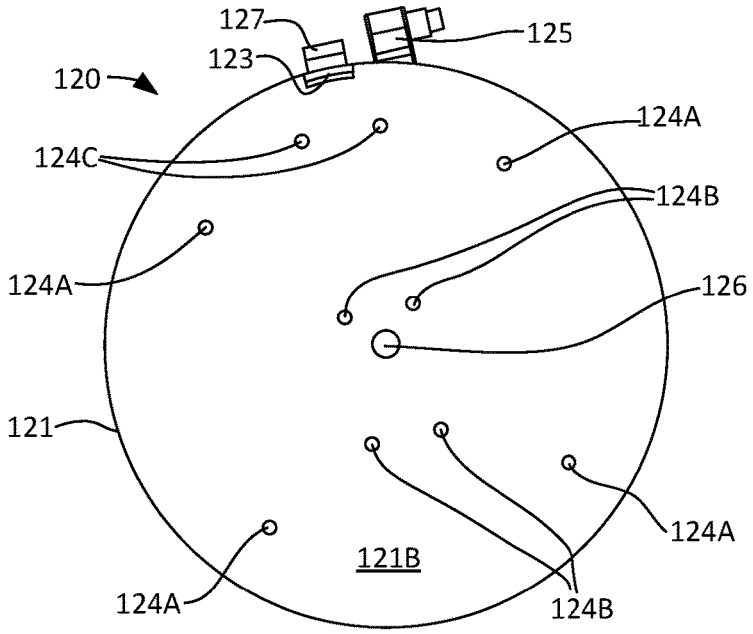
FIG. 3 is a bottom view of an embodiment of the disc housing of the primer collator of the present invention.
Figure 5:
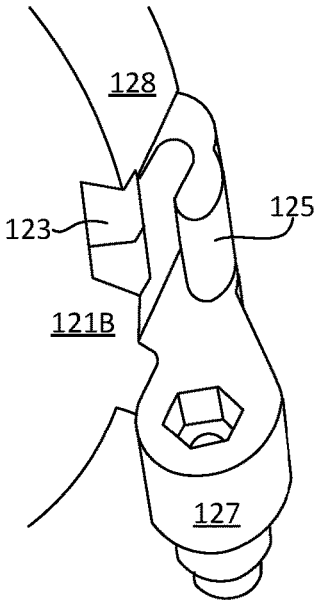
FIG. 5 is a perspective view of the primer output section of the disc housing of the primer collator of the present invention.
Figure 15:
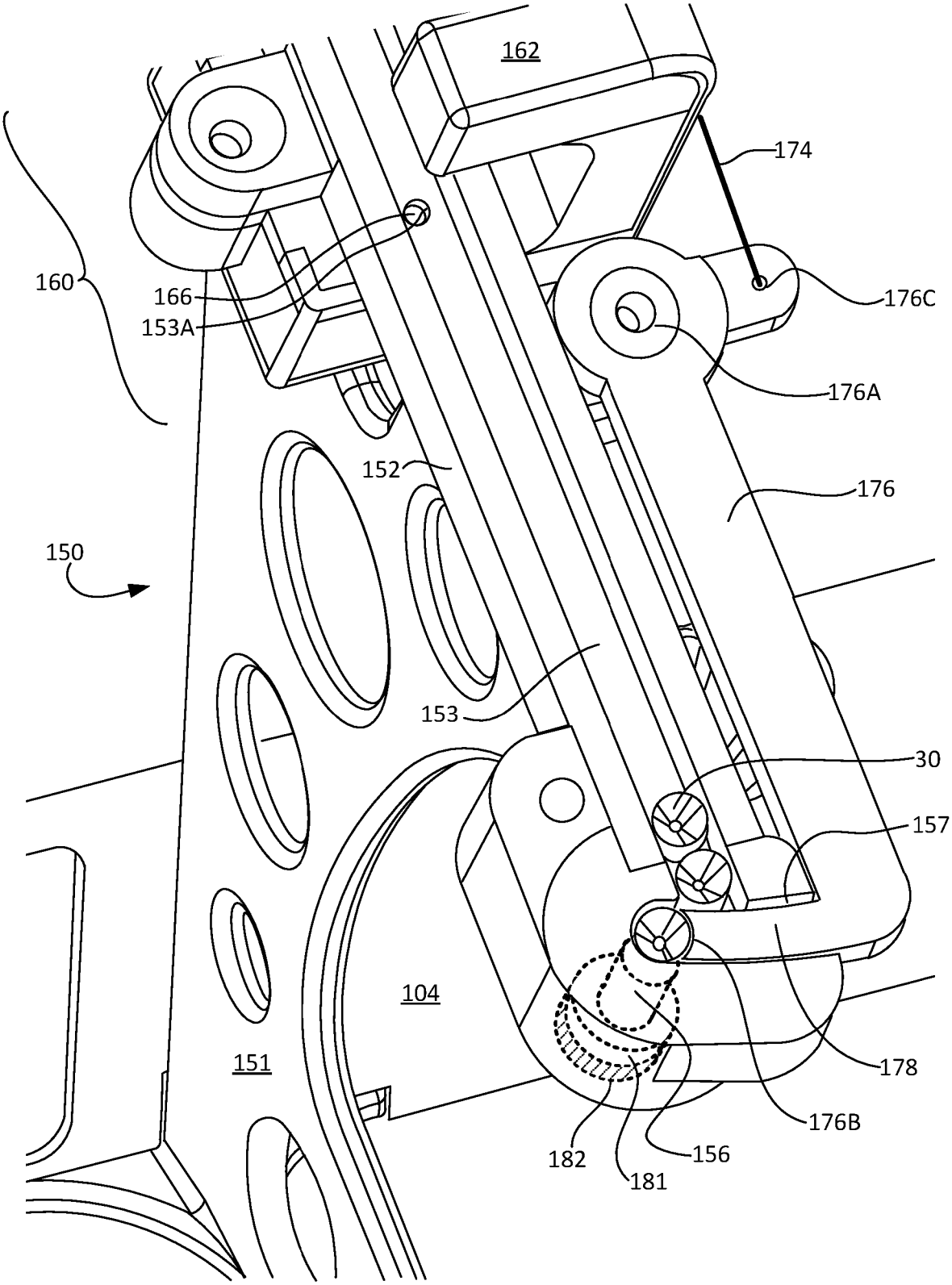
FIG. 15 is a perspective view of an embodiment of the output ramp and stabilizing arm of the primer collator of the present invention.
Figure 16:
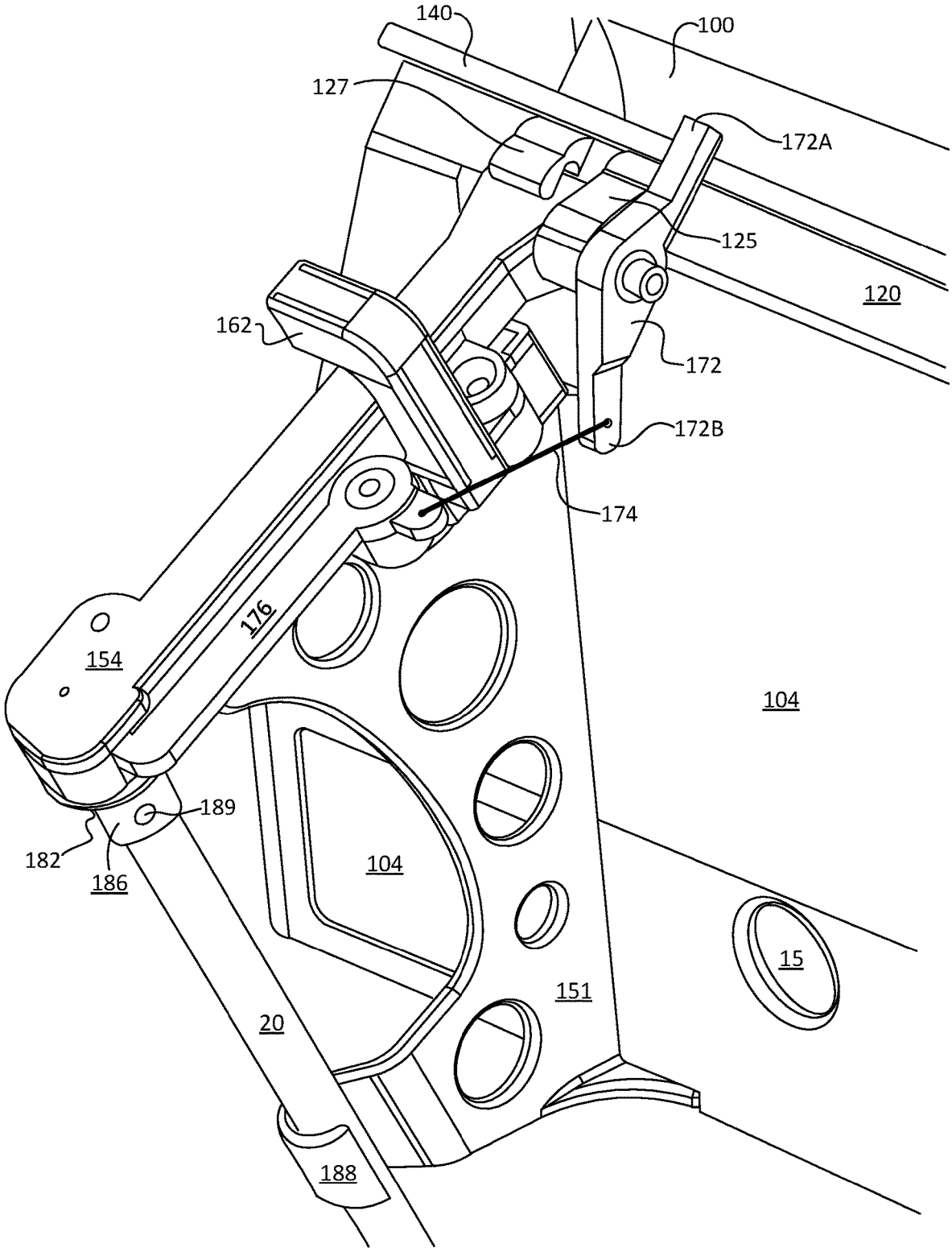
FIG. 16 is a perspective view of an embodiment of the output ramp, stabilizing arm, and timing level section of the primer collator of the present invention.

The present invention relates to a novel and useful primer collator 10 for use with standard primer tubes 20 as shown in FIGS. 1A-16. FIGS. 1A-2 illustrate the general features of primer collator 10, and FIGS. 3-11 illustrate the disc housing 120, priming disc 130, and timing disc 140 of the primer collator sorting assembly 110. FIGS. 12-14C illustrate how the disc housing 120, priming disc 130, and timing disc 140 cooperate to advance properly oriented primers 30 and reject improperly oriented primers 40, and FIGS. 15-16 illustrate the output ramp assembly 150, counting assembly 160, timing assembly 170, and tube connection assembly 180 of the primer collator.

As shown in FIG. 2, primer collator 10 includes a funnel 100 that cooperates with a sorting assembly 110. Funnel 100 and sorting assembly 110 are positioned on top of a housing 104 and tilted relative to the ground at angle A in order to allow gravity to assist with sorting primers when primer collator 10 is operating. Preferably angle A is 45 degrees, but any angle that facilitates sorting of primers as discussed below is acceptable. Housing 104 also provides support for output ramp assembly 150, counting assembly 160, and timing assembly 170. Housing 104 defines a housing cavity 104A in which a motor 106, controller 108, and additional support features (not labeled) are attached or integrally formed. Housing 104 can be any shape or size and preferably is configured so that it can rest on a flat surface while holding funnel 100 and sorting assembly 110 at a proper angle or tilt. Housing 104 also defines openings and supports as needed to facilitate attachment of and access to components of primer collator 10. For example, as shown in FIG. 16, housing 104 includes a port (not labeled) for access to a power switch 15.

Motor 106 preferably attaches to housing 104 immediately below sorting assembly 110 such that an output shaft 107 of motor 106 can be positioned to cooperate with sorting assembly 110 components. Motor 106 is preferably a small low power 12 volt motor and causes output shaft 107 to rotate either clockwise or counterclockwise about a central axis X, as shown in FIG. 2. Preferably, motor 106 runs at 10 rpm for optimal speed without sacrificing proper function.

Controller 108 or parts of controller 108 can be attached or positioned anywhere in housing cavity 104A and is preferably positioned to cooperate with and electrically communicate with motor 106, a power switch 15, counting assembly 160, and any other components as needed. Controller 108 includes any necessary components necessary to process user inputs, operate the motor 106, and facilitate counting of primers 30 with counting assembly 160. Controller 108 preferably houses together or among connected components any necessary control and processing components 109 such as a processor, memory, input and output components, wireless or wired communication components, or any other feature of a computer or controller system as is well known in the art. Software can be stored on the controller's memory and is preferably executable by the processor to perform many tasks, including, for example, counting the number of primers that travel pass the counting assembly sensor or initiating a pause in sorting when primers jam and cause a backup of primers on the output ramp. For example, if primers stack up on the output ramp such that they cover the counting assembly sensor and no longer move past it, controller software and hardware can stop the motor, display a visual warning using the counting assembly light source, and pause counting. After the operator clears the jam, he can restart the motor to resume counting or remove and empty the collator primers from the primer tube, reset the counter so that it counts anew, and restart the motor.

FIG. 2 also illustrates an interior cavity 100A formed by funnel 100 that is capable of holding many primers 30, 40. Preferably, funnel 100 can hold at least 100 primers 30, 40 at one time. More preferably, funnel 100 can hold as many as 300-500 primers at a time. Additionally, funnel 100 is configured such that it funnels primers 30, 40 toward a base opening 100B that is adjacent sorting assembly 110. Funnel 100 can be any rigid or semi-rigid material but is preferably plastic. Additionally, funnel 100 preferably attaches to sorting assembly 110 at base opening 100B, and more preferably with fasteners near base opening 100B that connect funnel 100 to sorting assembly 110. Opposite base opening 100*b*, a removable lid 102 preferably rests on the funnel 100, as shown in FIG. 2, to protect the operator when the primer collator is sorting. Lid 102 preferably also defines an opening 102A, which can be used to lift the lid.

Sorting assembly 110 sits between funnel 100 and housing 104. Preferably, sorting assembly 110 includes a disc housing 120, a primer disc 130, and a timing disc 140 that work together to form several rotatable and irregular slots 138 into which primers 30, 40 fall when the slots are positioned closest to the ground or in a down position. In FIG. 2, Primer 30A is shown in a slot positioned toward the ground or in a down position, and primers 40A, 30B are shown in a slot positioned away from the ground or in an up position. While disc housing 120, primer disc 130, and timing disc 140 are illustrated as three separate components, which is preferred, it should be understood by those skilled in the art that their features can be formed from more or fewer components depending on manufacturing capabilities.

Figure 4:
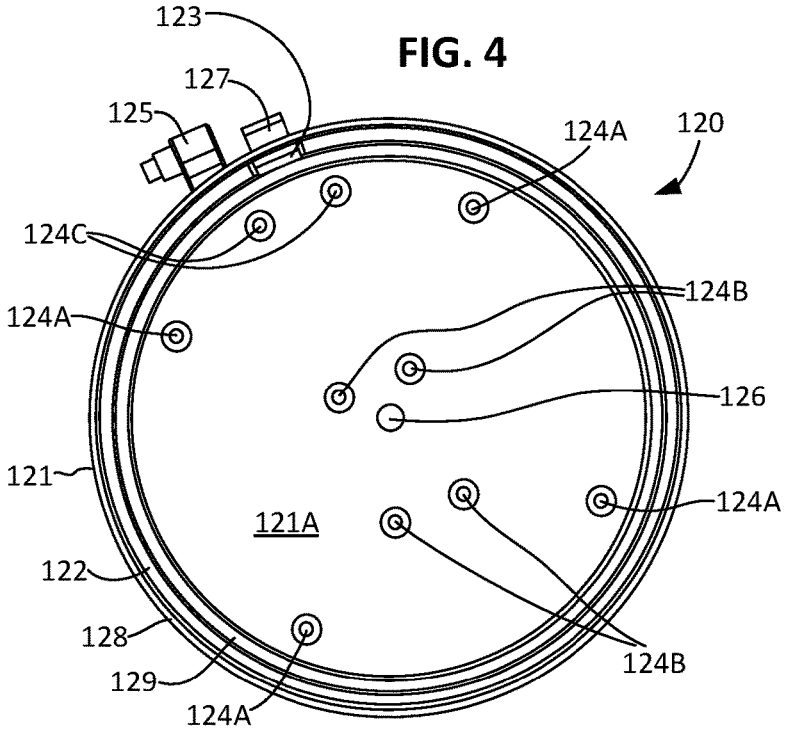
FIG. 4 is a top view of an embodiment of the disc housing of the primer collator of the present invention.

FIGS. 3-6 illustrate the preferred features of disc housing 120. As shown, disc housing 120 attaches to housing 104 with fasteners at openings 124 located around its perimeter. Disc housing 120 also has a substantially circular footprint and generally is a substantially solid plate 121 that has an upper surface 121A, a lower surface 121B, and an outer wall 128 that extends outward from and perpendicularly to upper surface 121A. While disc housing 120 is circular in shape, it remains stationary relative to housing 104 when motor 106 is operating. Disc housing plate 121 includes formed on its upper surface 121A a continuous groove 122 and a ridge 128 near its perimeter as shown in FIG. 4. Groove 122 and ridge 128 work together to contain and guide primers 30 around the perimeter of disc housing 120 as funnel 100, primer disc 130, and timing disc 140 rotate along with shaft 107 about central axis X. Disc housing 120 also defines openings 124B for accommodating fasteners that attach disc housing 120 to motor 106 and an additional opening 126 that accommodates output shaft 107 of motor 106. An output port 123 is located along groove 122 of disc housing 120 and is shown in FIG. 2 at its preferred location relative to the ground. Output port 123 cooperates with output ramp assembly 150, which connects to disc housing 120 at and under a latch 127. Latch 127 additionally secures and positions a lid 154 over output ramp assembly 150, which prevents primers 30 from tumbling, turning, or flipping as they travel through output ramp assembly 150. Positioned adjacent to latch 127 along disc plate 121 is an additional pivot connection 125 for timing assembly 170. Latch 127 and pivot connection 125 are preferably integrally formed with disc housing plate 121, but can be a separate components fixedly attached. Additionally, latch 127 and pivot connection 125 can be any type of fastener or connecter appropriate for holding two components together or for securely positioning removable components as will be understood by those skilled in the art.

Figure 6:
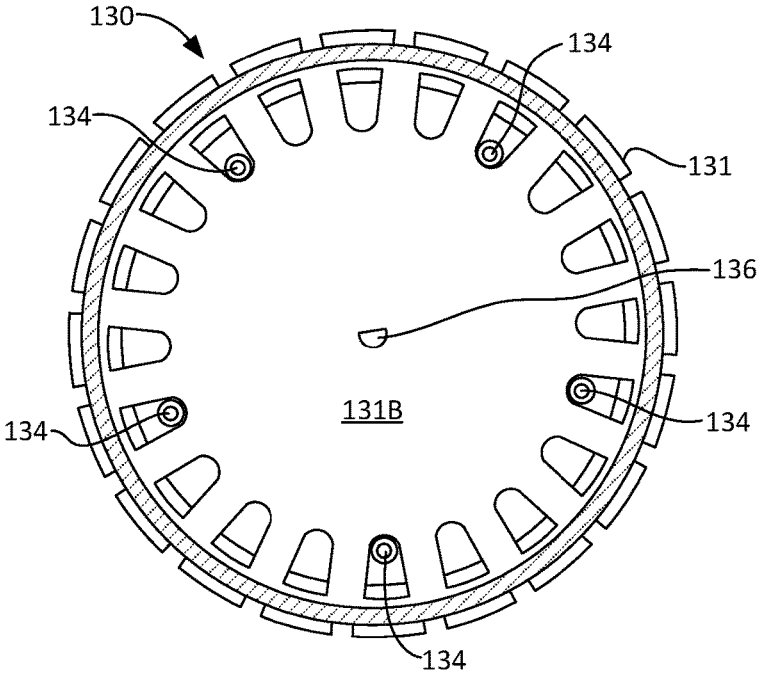
FIG. 6 is a bottom view of an embodiment of the primer disc of the primer collator of the present invention.
Figure 8:
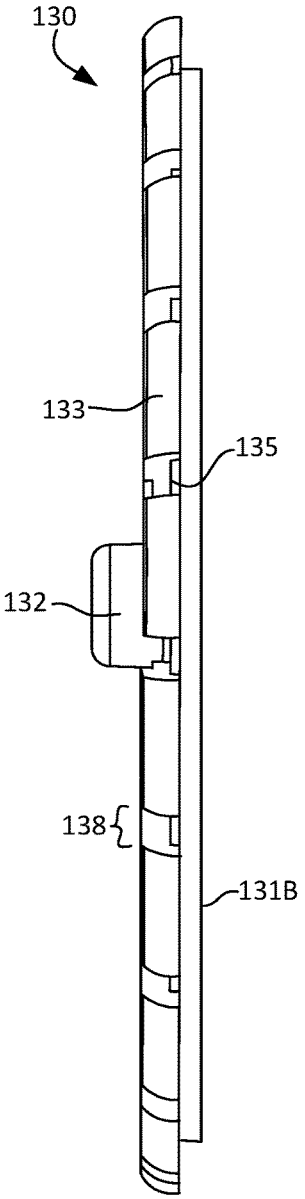
FIG. 8 is a side view of an embodiment of the primer disc of the primer collator of the present invention.
Figure 7:
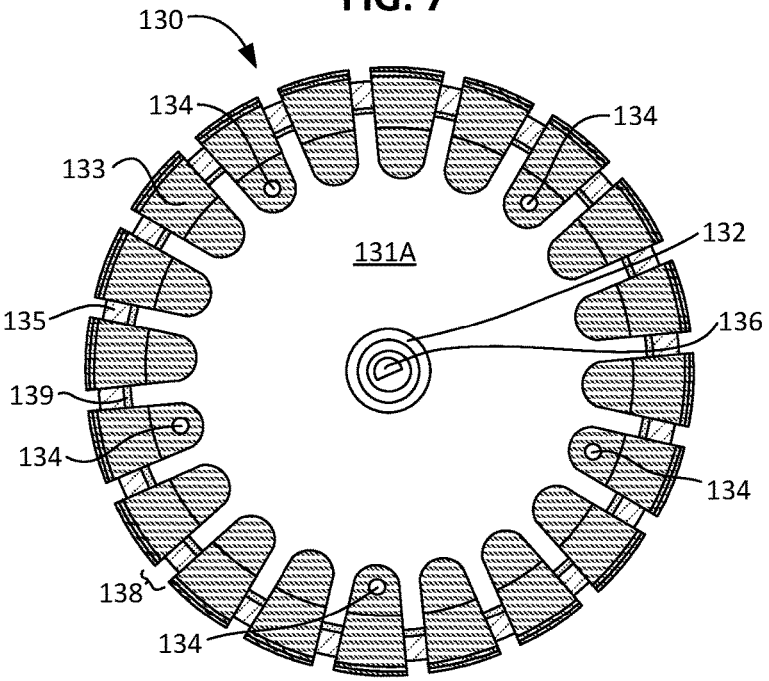
FIG. 7 is a top view of an embodiment of the primer disc of the primer collator of the present invention.
Figure 13A:
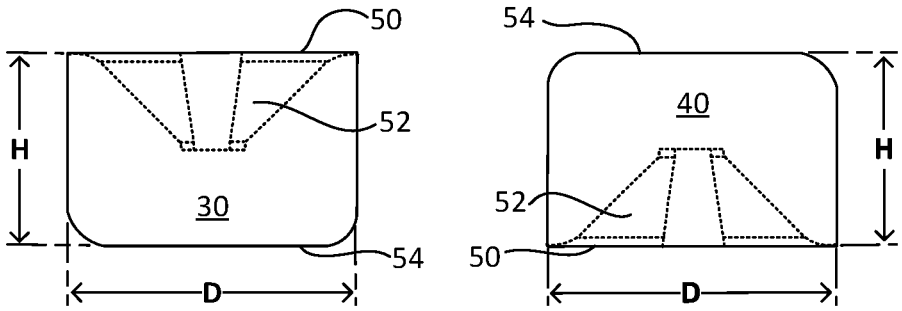
FIG. 13A is a side view of an anvil-side-up primer (properly oriented) and an anvil-side-down primer (improperly oriented) sitting side-by-side.
Figure 13B:
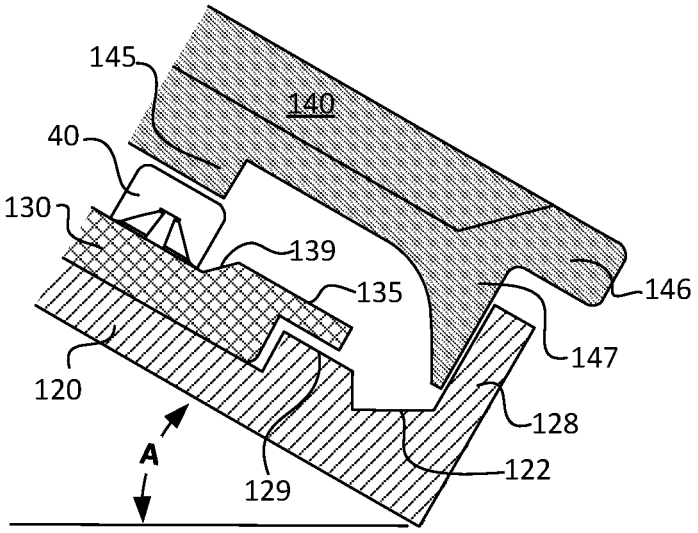
FIG. 13B is a side view of a section of the disc housing, primer disc, and timing disc as cut along the line marked 13-13 in FIG. 12 and an improperly oriented primer.

Nested substantially inside walls 128 and adjacent the upper surface 121A of disc housing plate 121 is primer disc 130, the preferred features of which are illustrated in FIGS. 6-8. Primer disc 130 includes a substantially flat and circular plate 131 having an upper surface 131A and lower surface 131B. Near its center, plate 131 includes a pillar 132 that extends substantially perpendicular from upper surface 131A. Pillar 132 includes an opening 136 that cooperates with the output shaft 107 of motor 106 such that when output shaft 107 rotates, primer disc 130 also rotates. Preferably, pillar 132 is also shaped and sized to facilitate guiding primers 30, 40 to the outer perimeter of funnel 100. Primer plate 131 includes on its upper surface 131A a substantially continuous ramp 139 and a substantially continuous ridge 135 near its perimeter as shown in FIGS. 6-7. Additionally primer plate 131 includes on its upper surface 131A several raised sections 133 that are sized and shaped to facilitate sorting primers 30, 40 into slots 138 formed between raised sections 133. Slots 138 are irregular due in part to their intersection with ramp 139 and ridge 135. As shown in FIG. 7, preferably primer plate 131 has 20 raised sections 133 evenly spaced around the perimeter of primer plate 131, which forms 20 slots 138. Alternatively, more or fewer raised sections 133 and corresponding slots 138 may be present depending on the overall diameter of the sorting assembly 110 components. For example there may be 22 raised sections 133 and slots 138 if sorting assembly 110 has a larger diameter and 18 raised sections 133 and slots 138 if sorting assembly 110 has a smaller diameter. Also preferably, each raised section 133 extends slightly beyond the perimeter of primer plate 131, and the widths of slots 138 at the area of ridge 135 and ramp 139 is slighter larger than the diameter D of primers 30, 40. A typical primer 30, 40 with diameter D is illustrated in FIG. 13A. Ramp 139, ridge 135, and raised sections 133 work together to guide primers 30 to the perimeter of disc housing 120 as funnel 100, primer disc 130, and timing disc 140 rotate. Primer plate 131 is preferably formed from a rigid material such as plastic. Its features also are preferably all integrally connected but can be separate components fixedly attached as will be understood by those skilled in the art. Additionally, primer plate 131 includes several openings 134 for accommodating fasteners and to facilitate attaching primer disc 130 with funnel 100 and timing assembly 140.

Figure 9:
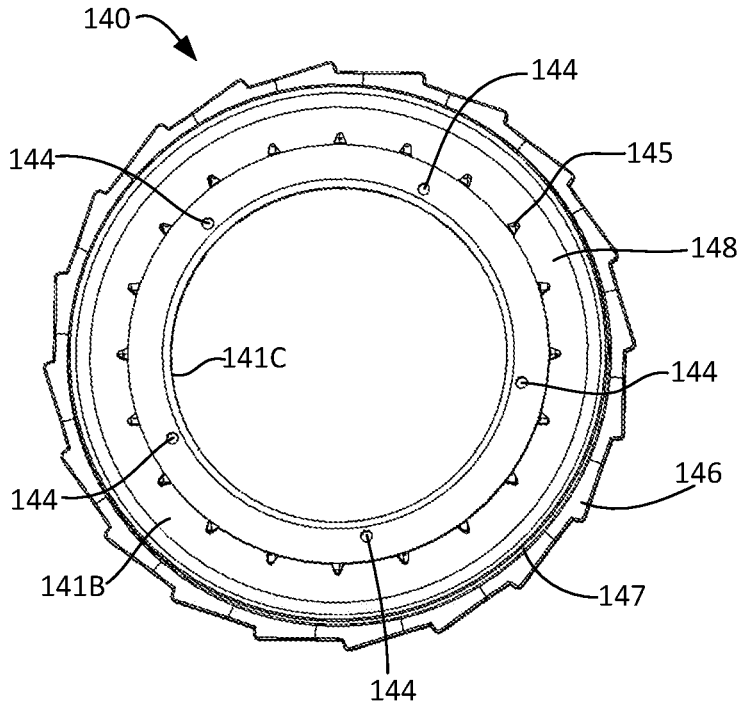
FIG. 9 is a bottom view of an embodiment of the timing disc of the primer collator of the present invention.
Figure 11:
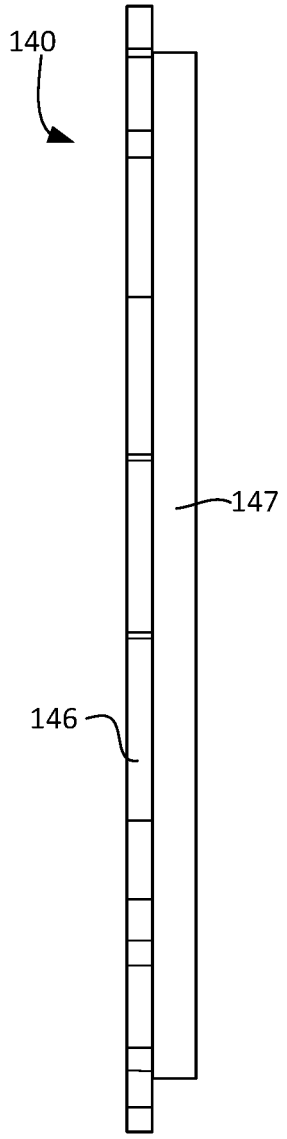
FIG. 11 is a side view of an embodiment of the timing disc of the primer collator of the present invention.
Figure 10:
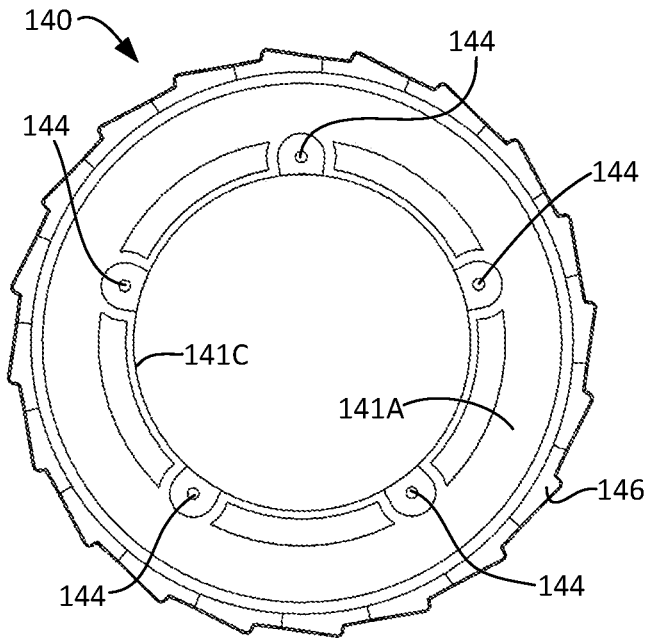
FIG. 10 is a top view of an embodiment of the timing disc of the primer collator of the present invention.
Figure 12:
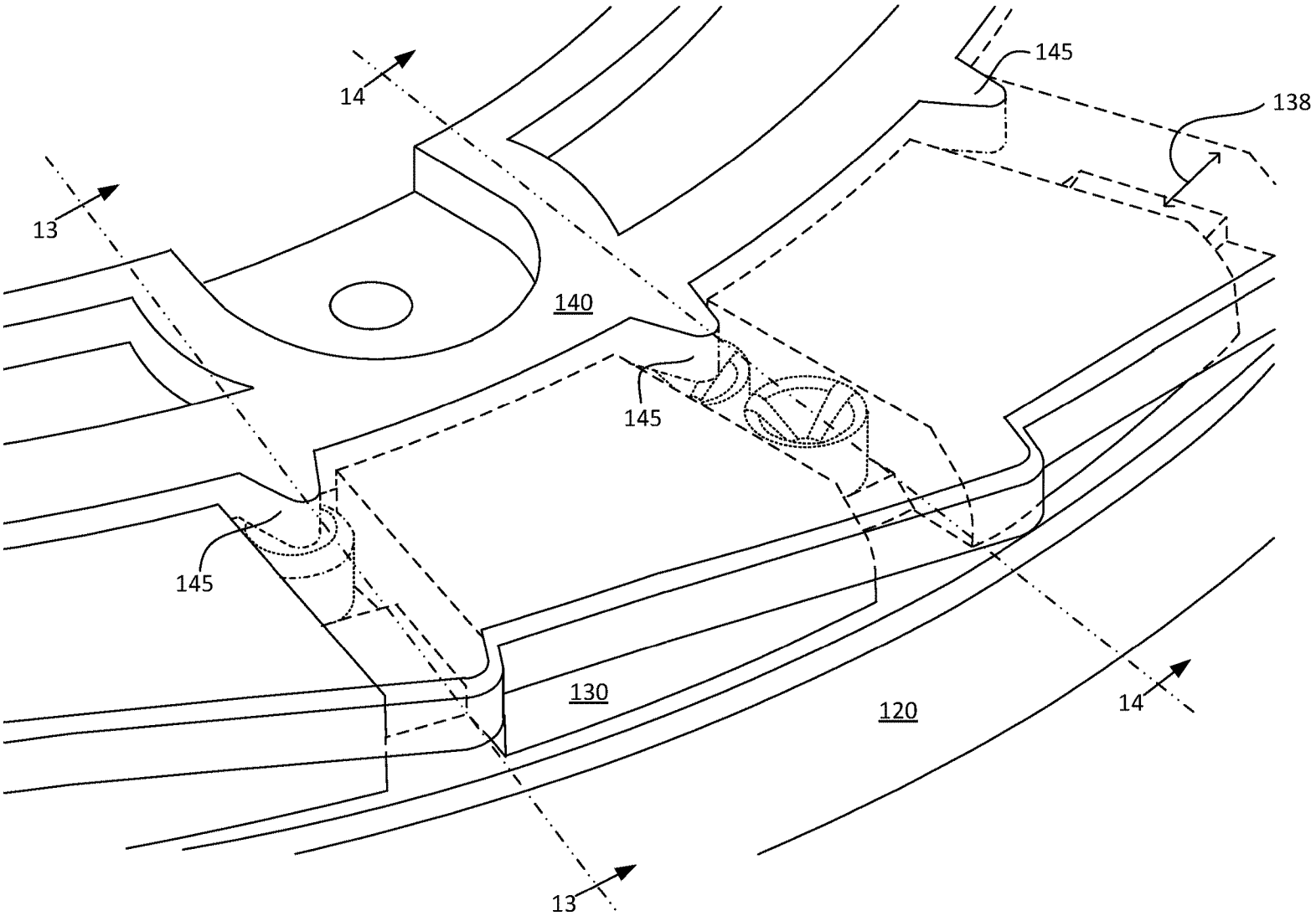
FIG. 12 is a perspective view of a section of the disc housing, primer disc, and timing disc of the primer collator of the present invention.

Positioned adjacent the upper surface 131A and raised sections 133 of primer plate 131 is timing disc 140, the preferred features of which are illustrated in FIGS. 9-11. Timing disc 140 includes a substantially flat and circular ring 141 having an upper surface 141A and lower surface 141B. Ring 141 defines a center opening 141C that generally corresponds to and cooperates with funnel base opening 100B as shown in FIG. 2. Near center opening 141C the clearance between primer plate 131 and ring 141 is slightly greater than the height H of a typical primer and less than the diameter D of a typical primer 30, 40 so that only primers 30, 40 that are resting substantially on their top surface 50 or bottom surface 54 can slide between plate 131 and ring 141. A typical primer with height H and diameter D is illustrated in FIG. 13A. Additionally near center opening 141C, there are several additional openings 144 spaced, sized, and configured to accept fasteners and to facilitate attachment of primer disc 120, timing disc 130, and funnel 140 such that when output shaft 107 of motor 106 rotates, primer disc 130, timing disc 140, and funnel 104 also rotate. Lower surface 141B of ring 141 includes a wall 147 that extends down from lower surface 141B, a groove 148 that extends around and near the outer perimeter of ring 141, and several teeth 145 that extend into groove 148 from the direction of the center of ring 141. Preferably, wall 147 is configured to partly rest just inside wall 128 of disc housing 120, and there are 20 teeth 145 equally spaced around groove 148. Additionally, groove 148 preferably is sized and positioned to cooperate with and accommodate ridge 135 of primer plate 131, and teeth 145 are sized and positioned to cooperate with ramp 139 of primer plate 131 when the primer disc 130 and timing disc are attached together. Teeth 145 and groove 148 further contribute to creating an irregular slot 138 shape. More preferably, the clearance between ridge 135 of primer plate 131 and groove 148 of ring 141 is only slightly greater that the height H of the sides of primers 30, 40. The clearance between each tooth 145 of ring 141 and ramp 139 of primer plate 131 is slightly less than the height H of the sides of primers 30 and 40 but great enough to allow anvil-side-up primers 30 to slide pass teeth 145 using the primer's recess 52. FIG. 13A illustrates how primers 30, 40 have a recess 52 at their top 50 and a substantially flat bottom 54. Preferably, each tooth 145 is shaped to fit within primer recess 52. Ring 141 also includes integral with or attached to its upper surface 141A several outward extending steps 146 surrounding its perimeter. Steps 146 are configured to protrude enough to trigger the cooperating timing assembly 170, and preferably there are the same number of steps 146 as there are slots 138 and teeth 145. More preferably there are twenty steps 146.

Figure 14A:
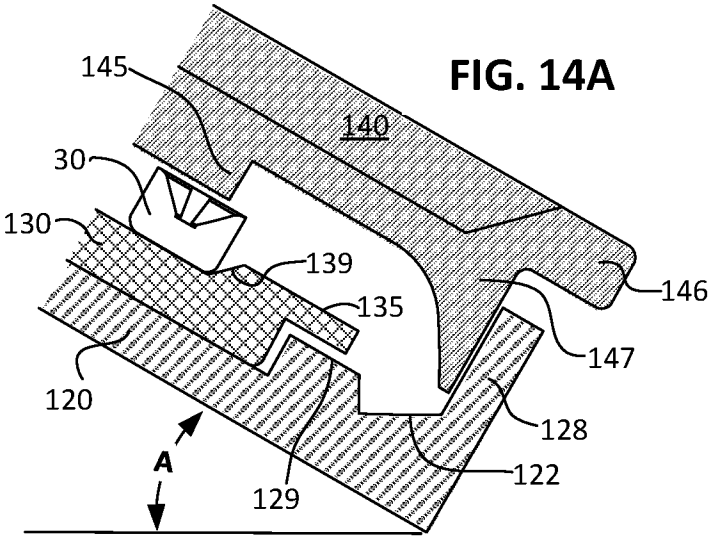
FIGS. 14A-14C are side views of a section of the disc housing, primer disc, and timing disc as cut along the line marked 14-14 in FIG. 12 and a properly oriented primer.
Figure 14C:
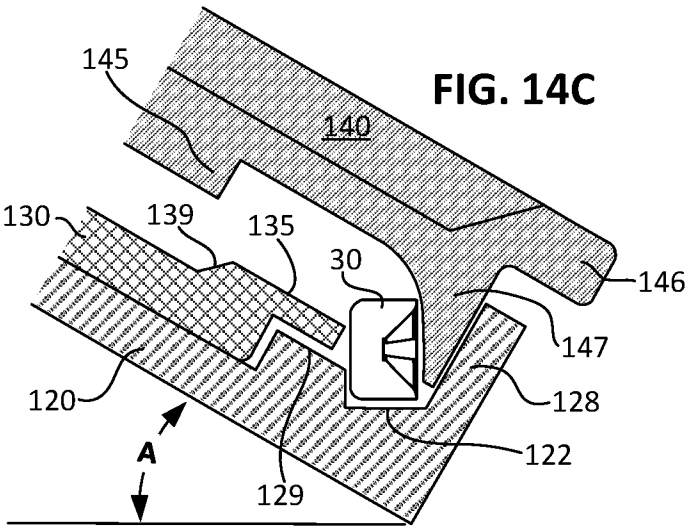
Figure 14B:
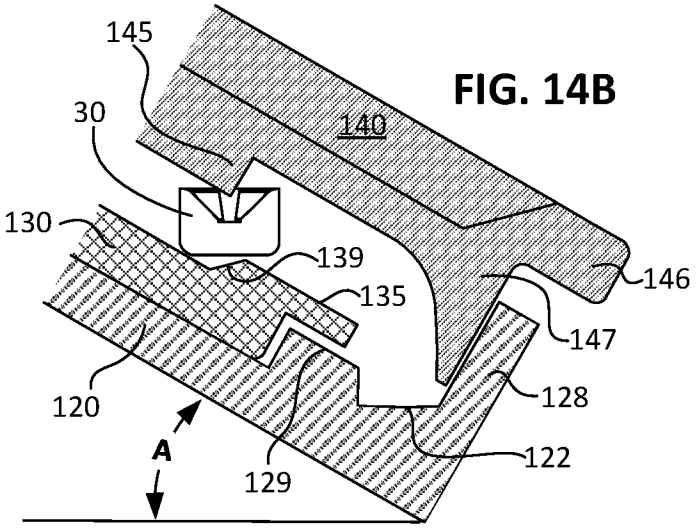

FIGS. 12-14C illustrate how sorting assembly 110 distinguishes between primers 30 that correctly have their anvil side oriented facing up and primers 40 that incorrectly have their anvil side oriented facing down after primers 30, 40 have descended into one of slots 138. In order for a primer to travel entirely through slot 138 to reach groove 122 of disc housing 120, the primer must be oriented anvil-side-up. FIG. 13A details the features of a primer, which include a substantially flat circular bottom 54, a height H, and a concave top 50 that includes recess 52 and additional primer components such as one or more flash holes and an anvil. FIG. 13B illustrates the lowest slot 138 of a sorting assembly tilted at angle A and an improperly oriented primer 40, which is oriented anvil-side-down (its top surface faces disc housing 120). FIGS. 14A-C illustrates the lowest slot 138 of a sorting assembly tilted at angle A and a properly oriented primer 30, which is oriented anvil-side-up (its top surface faces tooth 145 of timing disc 140 and away from disc housing 120). For each of FIGS. 13B and 14A-C, the preferred angle of tilt is 45 degrees, which uses gravity to coax primers 30, 40 to travel as far as they can down slot 138. As FIG. 13B illustrates, when an anvil-side-down primer 40 encounters tooth 145 of timing disc 140, it cannot maneuver around tooth 145 and travel over ramp 139. Accordingly, anvil-side-down primers 40 remain at the slot location shown in FIG. 13B as the priming disc 130 and timing disc 140 rotate and until gravity pulls them out of the slot and back into funnel 100. Conversely, as shown in sequence in FIGS. 14A-C, when an anvil-side-up primer 30 encounters tooth 145, it can maneuver past tooth 145 due to recess 52. FIG. 14B shows how anvil-side-up primer 30 passes tooth 145 and continues on ramp 139. After clearing tooth 145, anvil-side-up primer 30 then travels over ridge 135 and into groove 122, which is shown in FIG. 14C. Once in groove 122, anvil-side-up primer 30 is prevented from falling back into funnel 140 by ridge 135 as priming disc 130 and timing disc 140 rotate, and anvil-side-up primer 30 is pushed along groove 122 by sections 133 until it reaches output port 123 of disc housing 120. Output port 123 is in fluid communication with an output ramp 153 of cooperating output ramp assembly 150.

FIGS. 15-16 illustrate the features of the output ramp assembly 150, timing assembly 170, counting assembly 160, and tube connection assembly 180. Output ramp assembly 150 includes a support 151 that attaches to housing 104 and an output ramp 152 that defines a ramp groove 153 that is preferably slightly wider than diameter D and slightly deeper than height H of primers 30, a tube or output channel 156 preferably with a circular cross section with a diameter minimally greater than diameter D of primers 30, a tube connection channel 181 in fluid communication with output channel 156 and sized to accommodate primer tubes and adaptors as needed, and a slot 157 sized and configured to accommodate part of cooperating stabilizing arm 178 of timing assembly 170. Output ramp 152 also preferably defines a sensor channel 153A opening to and below ramp groove 153 that cooperates with a sensor 166 of cooperating counting assembly 160. Support 151 preferably holds and orients output ramp 152 at downward angle B so that gravity can help primers 30 slide down and through ramp groove 153. Preferably angle B is 25 degrees. Support 151 and ramp 152 are preferably made from a rigid material such as plastic and can be integrally formed or made from several fixedly attached parts. Removably positioned over ramp 152 so that ramp groove 153 is substantially covered is a ramp lid 154. Ramp lid 154 is either at least partly transparent or includes an opening or transparent section (not shown) where ramp lid 154 covers sensor channel 153A. Ramp 152 preferably anchors under latch 127 of disc housing 120, and support 151 preferably removably attaches with fasteners to disc housing 120 at plate openings 124C. Ramp 152 preferably prevents primers 30 from twisting, tumbling, or flipping as they travel down ramp roove 153.

Counting assembly 160 includes a counter housing 162 that preferably fixedly attaches to ramp 152 near sensor channel 153A. A first portion (not labeled) of counter housing 162 extends below sensor channel 153A and supports a light sensor 166 positioned directly below sensor channel 153A. A second portion (not labeled) of counter housing 162 extends up and over output ramp 152 and supports a light source 164 positioned directly above sensor channel 153A. The light source is preferably a light emitting diode. Together, the light sensor 166 and light source 164 cooperate to register when a primer passes over sensor channel 153A, and light fails to reach light sensor 166. With control and processing components that are separate from or included with control and processing components 109 of controller 108, counting assembly 160 counts every time a primer passes over opening 153A. Preferably, after a given number of primers 30 have been counted, primer collator 10 is powered off or a warning alert is activated. Also preferably, the operator of primer collator can reset the counter when needed.

Pivotally attached to pivot connection 125 of disc housing 120 is a timing lever 172. Timing lever 172 has a first end 172A that cooperates with steps 146 of timing disc 140 and a second end 172B that cooperates with a connection rod 174. Timing lever 172 is preferably connected with a torsion spring (not shown) that biases first end 172A of timing lever 172 toward the center of timing disc 140. Connection rod 174, which is preferably a steel rod such as a thin 1 mm spring-steel rod, links second end 172B to a first end 176A of a stabilizing arm 176. Connection rod 174 movably attaches to timing lever 172 and stabilizing arm 176 so that it does not distort during movement. Stabilizing arm 176 pivotally connects at first end 176A to ramp 152 or support 151 such that it is positioned next to ramp 152 and ramp groove 153. Stabilizing arm 176 also includes a hammer section 178 near a second end 176B of stabilizing arm 176 that extends into ramp groove 153 through ramp slot 157, as shown in detail in FIG. 15. Second end 176B is preferably notched or shaped to cooperate with the perimeter of a primer. In operation, as first end 172A of timing lever 172 is displaced by a step 146, it pulls the hammer section 178 of stabilizing arm 176 away from ramp groove 153 to allow a primer to slip into its second end 176B. When the timing lever first end 172A returns its default position closer to the center of timing disc 140, hammer section 178 and second end 176B of stabilizing arm 176 push primer 30 over so that is positioned directly over output channel 156. Second end 176 briefly holds and stabilizes primer 30 in this location until hammer section 178 begins to retract again. By briefly holding and stabilizing primer 30, stabilizing arm 176 causes primer 30 to remain horizontal and static directly over output channel 156 so that no sideways momentum or torque causes primer 30 to twist, flip, or turn, which substantially reduces the likelihood of a jam. Primer 30 then falls through output channel 156 to a primer tube connected directly beneath output channel 156.

Primer tube 20 can be properly oriented to cooperate with output channel 156 by using an optional and preferred tube connection assembly 180 as shown in FIGS. 2 and 15-16. Tube connection assembly includes a magnet housing 186 that houses a magnet 184 and a separate adaptor 182 that fits within connection channel 181 below output channel 156. Adaptor 182 preferably fixedly attaches directly to and within tube connection channel 181 or is otherwise integrally formed with ramp 152. Adaptor 182 is preferably a steel ring. Magnet housing 186 is configured to slide around the top end of a primer tube 20. Preferably, magnet housing 186 includes a fastener that centers primer tube 20 sufficiently so that primer tube 20 can easily align with output channel 156 when magnetically attached to adaptor 182. For example, one or more set screws 189 can be used to secure and align magnet 184 and magnet housing 186 around primer tube 20. Once installed at the top end of primer tube 20, primer tube 20 can attach to adaptor 182 and ramp 152 magnetically. Connection assembly optionally and preferably further includes a tube support 188 to provide additional support and positioning for primer tube 188. For example, as shown in FIG. 16, tube support 188 is integrally formed with support 151 and is configured to wrap partly around primer tube 20.

To operate primer collator 10, an operator attaches a primer tube 20 to the output ramp 152 at connection channel 181 below output channel 156, preferably using magnet housing 186 and adaptor 182. The operator then pours primers 30, 40 into funnel 100 and waits as funnel 100 and sorting assembly 110 sorts primers 30, 40. Any primer resting on its bottom surface 54 or top surface 50 will fall into slots 183 formed by timing disc 140 and primer disc 130 as they rotate. Any primer resting on its side remains in funnel 100. As anvil-side-up primers 30 rotate in slots 183, they encounter output ramp 123 in disc housing 120 and are consequently delivered to output ramp 152. As anvil-side-down primers 40 rotate in slots 183, they eventually slide back into funnel 100 to be sorted again. The sorted anvil-side-up primers 30 that are delivered to output ramp 152 then slide down ramp groove 153 of output ramp 152. As they slide down groove 153, they are counted by the counting assembly 160. At the same time, the timing assembly 170 and stabilizing arm 176 prepare primers 30 to fall into primer tube 20 correctly by catching and holding each primer 30 with stabilizing arm 176 as timing lever 172 interacts with steps on timing disc 140. After stabilized, each primer 30 falls into the attached primer tube 20 positioned below and output channel 156 of ramp 152. After counting 100 primers 30, the counting assembly 160 tells primer collator 10 to stop sorting. The operator can then remove primer tube 20 and empty it into a fixed primer tube on a reloading press or otherwise use it with a priming tool to reload ammunition. It is estimated that primer collator 10 can fill a primer tube with 100 primers in about 45-60 seconds.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

I claim:

1. A primer collator for use with a primer tube and a plurality of primers having a recessed anvil surface, the primer collator comprising:

a) a first housing;

b) a motor comprising a rotatable output shaft, wherein the motor is at least partly disposed in the first housing;

c) a sorting assembly defining a plurality of irregular slots positioned around its perimeter, a plurality of teeth disposed in the irregular slots, and an output port, wherein the sorting assembly attaches to the first housing at a first angle and to the output shaft of the motor such that the plurality of slots rotate around a central axis when the output shaft rotates, wherein the irregular slots rotate between an upper position and lower position, wherein the output port is positioned to cooperate with the irregular slots when they are in the upper position, and wherein the teeth are configured to cooperate with the recessed anvil surface of the primers;

d) a funnel defining a cavity and a base opening, wherein the funnel attaches to the sorting assembly near the base opening and such that the cavity is in fluid communication with the sorting assembly through the base opening; and e) an output ramp assembly comprising a ramp defining a ramp groove and an output channel in fluid communication with the ramp groove, wherein output ramp assembly attaches to the first housing such that the ramp groove is disposed at a second angle, wherein the ramp groove is in fluid communication with the output port of the sorting assembly, and wherein the output channel is configured to cooperate with the primer tube.

2. The primer collator of claim 1 wherein the sorting assembly comprises:

a) A disc housing fixedly attached to the first housing;

b) A primer disc comprising an outer perimeter and an upper surface, wherein the primer disc is rotatably disposed within the disc housing, wherein the primer disc comprises a plurality of raised sections disposed on its upper surface, wherein the primer disc defines a continuous ridge on its upper surface and spaced from the perimeter of the primer disc, and wherein the primer disc further defines a continuous ramp on its upper surface and positioned adjacent the continuous ridge; and c) A timing disc comprising an outer perimeter, a lower surface, and a central opening, wherein the timing disc is rotatably disposed within the disc housing and fixedly attached to the primer disc, wherein the timing disc defines a continuous groove on its lower surface and spaced from its outer perimeter, and wherein the timing disc comprises the plurality of teeth disposed on its lower surface such that each tooth extends into the groove defined by the timing disc;

wherein the timing disc groove aligns with the primer disc ridge and primer disc ramp when the timing disc is attached to the primer disc, wherein the timing disc teeth align with the primer disc ramp and are positioned between primer disc raised sections when the timing disc is attached to the primer disc, wherein the funnel fixedly attaches to the timing and primer discs, and wherein the funnel base opening is positioned adjacent to and is substantially equal in size and shape to the timing disc central opening such that the funnel cavity and the sorting assembly slots are in fluid communication when the funnel is attached to the timing and primer discs.

3. The primer collator of claim 2, wherein the primers have a height H and a diameter D, wherein the clearance between the primer disc and timing disc at each slot is greater than primer height H but less than primer diameter D except for at the location of each tooth where it is slightly less than primer height H and wherein the distance between the raised sections of the primer disc at the location of primer disc ramp and primer disc ridge is at least slightly more than primer diameter D and less than double primer diameter D.

4. The primer collator of claim 3 wherein the raised extensions of the primer disc extend at least partly beyond the perimeter of the primer disc, wherein disc housing defines a disc housing groove on a top surface of disc housing near its perimeter, wherein disc housing groove cooperates with the raised section of the primer disc where the raised section extends beyond the primer disc perimeter, and wherein the output port of the sorting assembly is defined by the disc housing along the disc housing groove.

5. The primer collator of claim 2 wherein the timing disc further comprises a plurality of steps extending from and along the perimeter of the timing disc and a timing assembly configured to interact with the timing disc steps.

6. The primer collator of claim 5 wherein the timing assembly comprises:

a) a timing lever comprising a first end and a second end, wherein the timing lever is pivotally connected to the disc housing;

b) a spring disposed between the timing lever and the disc housing, wherein the spring is configured to bias the first end of the timing lever toward the central axis of the sorting assembly such that the first end of the timing lever rests against the steps of the timing disc;

c) a stabilizing arm having a first end and a second end, wherein the stabilizing arm is pivotally connected to the output ramp assembly, wherein the second end of the stabilizing arm is disposed in a slot formed by the ramp of the output ramp assembly, and wherein the second end of the stabilizing arm is notched to cooperate with a primer disposed in the ramp groove; and d) a rigid connection rod disposed between and connected timing lever second end to stabilizing arm first end.

7. The primer collator of claim 1 wherein the first angle is 45 degrees.

8. The primer collator of claim 1 wherein the second angle is 25 degrees.

9. The primer collator of claim 1 further comprising:

a) a controller disposed in the first housing and in electrical communication with the motor; and b) a counting assembly fixedly attached to the output ramp assembly, positioned to recognize when a primer slides down the ramp groove, and in electrical communication with the controller.

10. The primer collator of claim 9, wherein the counting assembly comprises:

a) a light sensor positioned in a sensor channel defined by the ramp along the ramp groove; and b) a light source attached to the ramp assembly and positioned above the sensor such that when a primer is positioned in the ramp groove between the light source and the light sensor, the primer blocks light from reaching the light sensor.

11. The primer collator of claim 1 wherein the output ramp further defines a connection channel in fluid communication with the output channel and wherein the primer collator further comprises a tube connection assembly at least partly disposed in the connection channel.

12. The primer collator of claim 11 wherein the tube connection assembly further comprises:

a) a magnet housing configured to removably attach around one end of the primer tube;

b) a magnet disposed in the magnet housing; and c) a steel adaptor fixedly attached within the connection channel of the output ramp and configured to magnetically secure the magnet housing and primer tube in the connection channel of the output ramp.

13. A primer collator for use with a primer tube and a plurality of primers having a height H and a diameter D, the primer collator comprising:

a) a first housing;

b) a motor comprising a rotatable output shaft, wherein the motor is at least partly disposed in the first housing;

c) a sorting assembly attached to the first housing at a first angle, wherein the sorting assembly defines a plurality of rotatable irregular slots positioned around its perimeter and wherein the sorting assembly comprises:

i) a disc housing fixedly attached to the first housing, wherein the disc housing defines an output port;

ii) a primer disc comprising an outer perimeter and an irregular upper surface, wherein the primer disc attaches to the output shaft of the motor and is rotatably disposed within the disc housing and wherein the primer disc comprises a plurality of raised sections disposed on its upper surface that form the walls of the slots; and iii) a timing disc comprising a stepped outer perimeter, an irregular lower surface, a central opening, and a plurality of teeth disposed on the lower surface, wherein the timing disc is fixedly attached to the primer disc and rotatably disposed within the disc housing, wherein the teeth are positioned in the slots formed between the raised sections of the disc, and wherein each tooth reduces the clearance between upper surface of primer disc and the lower surface of the timing disc to less than height H;

d) a funnel defining a cavity and a base opening, wherein the funnel fixedly attaches to the timing and primer discs and wherein the funnel base opening is positioned adjacent to and is substantially equal in size and shape to the timing disc central opening such that the funnel cavity is in fluid communication with the sorting assembly slots formed in the space between the timing disc and primer disc when the funnel is attached to the timing and primer discs; and e) an output ramp assembly comprising a ramp defining a ramp groove and an output channel in fluid communication with the ramp groove, wherein output ramp assembly attaches to the first housing such that the ramp groove is disposed at a second angle, wherein the ramp groove is in fluid communication with the output port of the disc housing, and wherein the output channel is configured to cooperate with the primer tube.

14. The primer collator of claim 13, wherein the primers have a height H and a diameter D, wherein the clearance between the primer disc and timing disc at each slot is greater than primer height H but less than primer diameter D, and wherein the distance between the raised sections of the primer disc at the location of primer disc ramp and primer disc ridge is at least slightly more than primer diameter D and less than double primer diameter D.

15. The primer collator of claim 13 further comprising:

a) a controller disposed in the first housing and in electrical communication with the motor;

b) a light sensor positioned in a sensor channel defined by the output ramp along the ramp groove, wherein the light sensor is in electrical communication with the controller; and c) a light source attached to the ramp assembly and positioned above the sensor such that when a primer is in the ramp groove at the location of the light sensor, the primer blocks light from reaching the light sensor.

16. The primer collator of claim 13 further comprising:

a) a timing lever comprising a first end and a second end, wherein the timing lever is pivotally connected to the disc housing;

b) a spring disposed between the timing lever and the disc housing, wherein the spring is configured to bias the first end of the timing lever toward the central axis of the sorting assembly such that the first end of the timing lever rests against the stepped perimeter of the timing disc;

c) a stabilizing arm having a first end and a second end, wherein the stabilizing arm is pivotally connected to the output ramp assembly, wherein the second end of the stabilizing arm is disposed in a slot formed by the ramp of the output ramp assembly, and wherein the second end of the stabilizing arm is notched to cooperate with a primer disposed in the ramp groove; and d) a rigid connection rod disposed between and connected timing lever second end to stabilizing arm first end.

17. The primer collator of claim 13 wherein the output ramp further defines a connection channel in fluid communication with the output channel and wherein the primer collator further comprises:

a) a magnet housing configured to removably attach around one end of the primer tube;

b) a magnet disposed in the magnet housing; and c) a steel adaptor fixedly attached within the connection channel of the output ramp and configured to magnetically secure the magnet housing and primer tube in the connection channel of the output ramp.

18. A primer collator for use with a primer tube and a plurality of primers having a recessed anvil surface, the primer collator comprising:

a) a first housing;

b) a motor comprising a rotatable output shaft, wherein the motor is at least partly disposed in the first housing;

c) a controller disposed in the first housing and coupled with the motor;

d) a sorting assembly defining a plurality of steps extending out from its perimeter, a plurality of irregular slots positioned around and near its perimeter, a plurality of teeth disposed in the irregular slots, and an output port, wherein the sorting assembly attaches to the first housing at a first angle and to the output shaft of the motor such that the plurality of slots rotate around a central axis when the output shaft rotates, wherein the irregular slots rotate between an upper position and lower position, wherein the output port is positioned to cooperate with the irregular slots when they are in the upper position, and wherein the teeth are configured to cooperate with the recessed anvil surface of the primers;

e) a funnel defining a cavity and a base opening, wherein the funnel attaches to the sorting assembly near the base opening and such that the cavity is in fluid communication with the sorting assembly through the base opening;

f) an output ramp assembly comprising a ramp defining a ramp groove, an output channel in fluid communication with the ramp groove, and a sensor channel along the ramp groove, wherein output ramp assembly attaches to the first housing such that the ramp groove is disposed at a second angle, wherein the ramp groove is in fluid communication with the output port of the sorting assembly, and wherein the output channel is configured to cooperate with the primer tube;

g) a light sensor positioned in the sensor channel defined by the output ramp along the ramp groove, wherein the light sensor is coupled with the controller;

h) a light source attached to the ramp assembly and positioned above the sensor such that when a primer is in the ramp groove at the location of the light sensor, the primer blocks light from reaching the light sensor;

i) a biased timing lever comprising a first end and a second end, wherein the timing lever is pivotally connected to the sorting assembly and biased at its first end toward the center of the sorting assembly such that it rests against the sorting assembly steps;

j) a stabilizing arm having a first end and a second end, wherein the stabilizing arm is pivotally connected to the output ramp assembly, wherein the second end of the stabilizing arm is disposed in a slot formed by the ramp of the output ramp assembly, and wherein the second end of the stabilizing arm is notched to cooperate with a primer disposed in the ramp groove; and k) a rigid connection rod disposed between and connected timing lever second end to stabilizing arm first end.

19. The primer collator of claim 18 wherein the controller is programmed to receive data from the light sensor, count the primers as they pass the light sensor, and stop the motor after counting 100 primers.

20. The primer collator of claim 19 wherein the controller is further programmed to recognize when a primer blocks the light sensor rather than passes over the light sensor, pause counting of the primers and stop the motor, and resume counting when the motor restarts.

* * * * *